United States Patent [19]

Tack et al.

[11] Patent Number: 4,464,182

[45] Date of Patent: Aug. 7, 1984

[54] GLYCOL ESTER FLOW IMPROVER ADDITIVE FOR DISTILLATE FUELS

[75] Inventors: Robert D. Tack, Abingdon; Kenneth Lewtas, Wantage; John R. Brazier, Oxford, all of United Kingdom

[73] Assignee: Exxon Research & Engineering Co., Florham Park, N.J.

[21] Appl. No.: 359,022

[22] Filed: Mar. 17, 1982

[30] Foreign Application Priority Data

Mar. 31, 1981 [GB] United Kingdom ..... 8110081
Nov. 20, 1981 [GB] United Kingdom ..... 8135071

[51] Int. Cl.[3] ..... C10L 1/22

[52] U.S. Cl. ..... 44/62; 44/66; 44/70; 44/71

[58] Field of Search ..... 44/62, 70, 66, 71

[56] References Cited

U.S. PATENT DOCUMENTS

| | | | |
|---|---|---|---|
| 3,374,073 | 3/1968 | Gergel | 44/62 |
| 3,444,082 | 5/1969 | Kautsky | 252/51.5 |
| 3,499,741 | 3/1970 | Sweeney | 44/62 |
| 3,507,636 | 4/1970 | Sweeney | 44/62 |
| 3,524,732 | 6/1970 | Sweeney et al. | 44/62 |
| 3,608,231 | 9/1971 | Sweeney | 44/62 |
| 3,658,493 | 4/1972 | Hollyday, Jr. | 44/62 |
| 3,661,541 | 5/1972 | Hollyday, Jr. | 44/62 |
| 3,679,380 | 7/1972 | Biswell et al. | 44/62 |
| 3,681,307 | 8/1972 | Wilmer et al. | 260/80.7 |
| 3,762,888 | 10/1978 | Kober et al. | 44/62 |
| 3,846,093 | 11/1974 | Feldman | 44/62 |
| 3,982,909 | 9/1976 | Hollyday, Jr. | 44/66 |
| 4,211,534 | 7/1980 | Feldman | 44/71 |

FOREIGN PATENT DOCUMENTS

| | | |
|---|---|---|
| 848777 | 9/1960 | United Kingdom . |
| 900202 | 7/1962 | United Kingdom . |
| 993744 | 6/1965 | United Kingdom . |
| 1068000 | 5/1967 | United Kingdom . |
| 1263152 | 2/1972 | United Kingdom . |
| 1374051 | 11/1974 | United Kingdom . |

OTHER PUBLICATIONS

Smalheer et al., Lubricant Additives, Mar. 1967, pp. 8 and 9.

*Primary Examiner*—Charles F. Warren
*Assistant Examiner*—Mrs. Y. Harris-Smith
*Attorney, Agent, or Firm*—J. J. Mahon

[57] ABSTRACT

Polyoxyalkylene esters, ethers,ester/ethers or mixtures thereof containing two $C_{10}$–$C_{30}$ linear saturated alkyl groups and a polyoxy ($C_1$–$C_4$) alkylene glycol group of molecular weight 200 to 5,000 have been found to be effective distillate fuel flow improvers, especially for narrow boiling distillates hitherto difficult to treat, they may also be used in combination with conventional additives such as ethylene/unsaturated ester copolymers and nitrogen compounds such as diamides or amide/amine salts, ester/amides of dicarboxylic acids.

25 Claims, No Drawings

GLYCOL ESTER FLOW IMPROVER ADDITIVE FOR DISTILLATE FUELS

Additive systems for treating distillate fuel oil to improve the flow of wax cloudy fuels through pipelines and filters in cold weather are known, as shown by the following patents.

U.K. Pat. Nos. 900,202 and 1,263,152 relate to the use of low molecular weight copolymers of ethylene and unsaturated esters especially vinyl acetate, whilst U.K. Pat. No. 1,374,051 relates to the use of an additive system which both raises the temperature at which wax crystallisation starts and limits the size of the wax crystals. The use of low molecular weight copolymers of ethylene and other olefins as pour point depressants for distillate fuels is described in U.K. Pat. Nos. 848,777, 993,744 and 1,068,000 and U.S. Pat. No. 3,679,380. Various other special types of polymers are suggested as additives for distillate fuels in U.S. Pat. Nos. 3,374,073, 3,499,741, 3,507,636, 3,524,732, 3,608,231 and 3,681,302.

It has also been proposed that combinations of additives may be used in distillate fuels to further improve their flow and pour point properties. For example, U.S. Pat. No. 3,661,541 is concerned with the use of combinations of the ethylene/unsaturated ester copolymers types of additive and low molecular weight ethylene/-propylene copolymer of U.K. Pat. No. 993,744.

U.S. Pat. No. 3,658,493 teaches various nitrogen salts and amides of acids such as mono and dicarboxylic acids, phenols, and sulfonic acids in combination with ethylene homo or copolymeric pour point depressants for middle distillate oils. U.S. Pat. No. 3,982,909 teaches that nitrogen compounds such as amides, diamides and ammonium salts of monoamides or monoesters of dicarboxylic acids, alone or in combination with petroleum derived microcrystalline wax and/or a pour point depressant, particularly an ethylene backbone, polymeric pour point depressant, are wax crystal modifiers and cold flow improvers for middle distillate fuel oils, including diesel fuel.

U.S. Pat. Nos. 3,444,082 and 3,846,093 teach the use of various amides and amine salts of alkenyl succinic anhydride in combination with ethylene copolymer pour point depressants, for distillate fuels.

U.S. Pat. No. 3,762,888 teaches a flow improver additive for middle distillate fuels containing a first component polymer such as an ethylene copolymer and as a second component a variety of organic compounds characterised as containing a straight chain polymethylene segment being selected from the group of fatty esters of polyols, alkoxylated polyethers, alkanol esters and the like. Most importantly, with regard to the present invention, this U.S. Patent reports that the second component is one which generally yields little or no flow-improving properties when used in the absence of the polymeric first component.

The present invention is based upon the discovery that a certain category of polyoxyalkylene esters, ethers, ether/esters and mixtures thereof are effective per se as flow improvers for distillate fuels and are especially effective and can be used as the sole additive for narrow boiling distillate fuels (as hereinafter described) which in many cases are unresponsive to conventional flow improver additives. The use of such narrow boiling distillates is increasing due to demands upon refineries to produce more distillates in the kerosene range which raises the initial boiling point of the middle distillate and thus requires a reduction in the final boiling point of the distillate in order to meet cloud point specifications. These narrow boiling distillates therefore have a relatively higher initial boiling point and a relatively lower final boiling point.

Whilst additives of the prior art are useful, generally speaking, in distillate fuel oils boiling in the range of 120° C. to 500° C., especially 160° C. to 400° C., for controlling the growth of separating wax crystals there is a need for further improvement. It has, however, been found difficult to improve the flow and filterability of distillate oils having a relatively narrow boiling range. It has now been found that certain polyalkylene esters, ethers, ester/ethers or mixtures thereof are especially useful in treating narrow boiling distillate fuels to improve their flow properties. The term "narrow boiling distillate" is meant to include those distillate fuels boiling in the range of 200° C.±50° C. to 340° C.±20° C.; fuels having boiling characteristics outside this range being referred to as broad boiling distillates.

The present invention therefore provides the use as a flow improver additive for distillate fuel oils especially narrow boiling distillate fuel oils of polyoxyalkylene esters, ethers, ester/ethers and mixtures thereof, containing at least two $C_{10}$ to $C_{30}$ linear saturated alkyl groups and a polyoxyalkylene glycol of molecular weight 100 to 5,000 preferably 200 to 5,000, the alkyl group in said polyoxyalkylene glycol containing from 1 to 4 carbon atoms.

In addition the invention in its broader aspect provides a distillate fuel oil boiling in the range 120° C. to 500° C. containing from 0.0001 to 0.5 wt % preferably 0.001 to 0.5 wt.% of the aforesaid polyalkylene ester, ether, ester/ether or mixtures thereof as flow improver additives either alone or in combination with other flow improver additives.

The preferred esters, ethers or ester/ethers useful in the present invention may be structurally depicted by the formula:

$$R—O—(A)—O—R^1$$

where R and $R^1$ are the same or different and may be (i) n-Alkyl (ii) $$\text{n-Alkyl-}\overset{\overset{\displaystyle O}{\|}}{C}—$$

(iii) $$\text{n-Alkyl-O}—\overset{\overset{\displaystyle O}{\|}}{C}—(CH_2)_n—$$

(iv) $$\text{n-Alkyl-O}—\overset{\overset{\displaystyle O}{\|}}{C}—(CH_2)_n—\overset{\overset{\displaystyle O}{\|}}{C}—$$

the alkyl group being linear and saturated and containing 10 to 30 carbon atoms, and A represents the polyoxyalkylene segment of the glycol in which the alkylene group has 1 to 4 carbon atoms such as a polyoxymethylene, polyoxyethylene or polyoxytrimethylene moiety which is substantially linear; some degree of branching with lower alkyl side chains (such as in polyoxypropylene glycol) may be tolerated but in order to achieve the objective of the invention the glycol should be substantially linear.

Suitable glycols generally are the substantially linear polyethylene glycols (PEG) and polypropylene glycols (PPG) having a molecular weight of about 100 to 5,000 preferably about 200 to 2,000, the latter range being especially useful for improving the flow properties of narrow boiling distillates.

Esters are the preferred additives of this invention and fatty acids containing about 10–30 carbon atoms are useful for reacting with the glycols to form the ester additives of the present invention but where the additive is to be used in narrow boiling distillates it is preferred to use a $C_{18}$–$C_{24}$ fatty acid, especially behenic acid or mixtures of stearic and behenic acids, the esters may also be prepared by esterifying polyethoxylated fatty acids or polyethoxylated alcohols.

Polyoxyalkylene diesters, diethers, ether/esters and mixtures thereof are suitable as additives with diesters preferred for use in narrow boiling distillates whilst minor amounts of monoethers and monoesters may also be present and are often formed in the manufacturing process it is important for additive performance that a major amount of the dialkyl compound is present. In particular stearic or behenic diesters of polyethylene glycol, polypropylene glycol or polyethylene/polypropylene glycol mixtures are preferred.

Therefore, a preferred embodiment of the present invention provides narrow boiling distillate fuels as hereinbefore defined which are improved in their flow and filterability properties containing as a flow improver the ester, ether or ester/ether of a polyethylene glycol or polypropylene glycol of molecular weight 100 to 5,000 and a $C_{18}$–$C_{24}$ fatty acid in an amount of from about 0.0001 to 0.5 wt %, preferably in the range of 0.005 to 0.05 wt % based upon the weight of the fuel being treated. Where a polyethylene glycol derivative is used we prefer the polyethylene glycol to have a molecular weight from 200 to 1500, where a polypropylene glycol is used we prefer it has a molecular weight from 200 to 2000. Most preferably the polyalkylene glycol has a molecular weight from 200 to 800.

The polyoxyalkylene esters, ethers or ether/esters may be used as sole additive or in conjunction with other additives. With narrow boiling distillates which are known to be generally unresponsive to conventional additives the polyoxyalkylene esters, ethers or ester/ethers of the present invention are frequently effective as sole additives. In broad boiling distillate fuels, however, the ester, ether or ester/ether additives of the present invention are preferably used in combination with other flow improver additives.

These flow improver additive combinations of the aforesaid polyoxyalkylene esters, ethers, ester/ether or mixtures thereof with other additives comprise a further embodiment of the present invention.

In broader boiling distillate fuels the other additives are preferably halogenated polymers of ethylene especially chlorinated polyethylene and more preferably copolymers of ethylene with other unsaturated monomers. More generally these other conventional additives are ethylene copolymers typically characterized as wax crystal modifiers of Vapor Pressure Osmometric (V.P.O.) Mn 500 to 10,000 containing 3 to 40, preferably 4 to 20 moles of ethylene per mole of a second ethylenically unsaturated monomer. The ethylene/vinyl acetate copolymer flow improvers are especially preferred. Combinations made up of 90 to 10, preferably 50 to 10 more preferably about 20%–40% by wt polyoxyalkylene ester or ether of this invention and 10 to 90, preferably 50 to 90 more preferably about 80% to 60% by wt of the ethylene/unsaturated ester copolymer are preferred. The ethylene/vinyl acetate copolymers, especially those containing 10 to 40 wt.% more preferably containing about 25 to 35 wt.% vinyl acetate, and having a vapour pressure osmometry (VPO) number average molecular weight of about 1,000 to 6,000, preferably 1500 to 4500 are the preferred co-additives. The dibehenate of polyethylene glycol of molecular weight 200 to 1500 especially 800 to 1500 is a preferred glycol ester for use in such combinations.

The unsaturated monomers which may be copolymerized with ethylene, include unsaturated mono and diesters of the general formula:

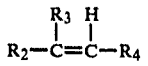

wherein $R_3$ is hydrogen or methyl; R is a —$OOCR_5$ group wherein $R_5$ is hydrogen or a $C_1$ to $C_{28}$, more usually $C_1$ to $C_{17}$, and preferably a $C_1$ to $C_8$, straight or branched chain alkyl group; or $R_2$ is a —$COOR_5$ group wherein $R_5$ is as previously described but is not hydrogen and $R_4$ is hydrogen or —$COOR_5$ as previously defined. The monomer, when $R_2$ and $R_4$ are hydrogen and $R_2$ is —$OOCR_5$, includes vinyl alcohol esters of $C_1$ to $C_{29}$, more usually $C_1$ to $C_{18}$, monocarboxylic acid, and preferably $C_2$ to $C_5$ monocarboxylic acid. Examples of such esters include vinyl acetate, vinyl isobutyrate, vinyl laurate, vinyl myristate and vinyl palmitate; vinyl acetate being the preferred vinyl ester. When $R_2$ is —$COOR_5$ and $R_3$ is hydrogen, such esters include methyl acrylate, isobutyl acrylate, methyl methacrylate, lauryl acrylate, $C_{13}$ Oxo alcohol esters of methacrylic acid, etc. Examples of monomers where $R_3$ is hydrogen and $R_2$ and $R_4$ are —$COOR_5$ groups, include mono and diesters of unsaturated dicarboxylic acids such as mono $C_{13}$ Oxo fumarate, di-$C_{13}$ Oxo fumarate, diisopropyl maleate, di-lauryl fumarate and ethyl methyl fumarate.

The polyoxyalkylene esters, ethers or ester/ethers of the present invention may be used in distillate fuels in combination with polar compounds, either ionic or nonionic, which have the capability in fuels of acting as wax crystal growth inhibitors. Polar nitrogen containing compounds have been found to be especially effective when used in combination with the glycol esters, ethers or ester/ethers of the present invention and these are generally the $C_{30}$–$C_{300}$ preferably $C_{50}$–$C_{150}$ amine salts and/or amides formed by reaction of at least one molar proportion of hydrocarbyl substituted amines with a molar proportion of hydrocarbyl acid having 1–4 carboxylic acid groups or their anhydrides; ester/amides may also be used. These nitrogen compounds are described in U.S. Pat. No. 4,211,534. Suitable amines are usually long chain $C_{12}$–$C_{40}$ primary, secondary, tertiary or quarternary amines or mixtures thereof but shorter chain amines may be used provided the resulting nitrogen compound is oil soluble and therefore normally containing about 30 to 300 total carbon atoms. The nitrogen compound should also have at least one straight chain $C_8$–$C_{40}$ alkyl segment.

Suitable amines include primary, secondary, tertiary or quaternary, but preferably are secondary. Tertiary and quaternary amines can only form amine salts. Examples of amines include tetradecyl amine, cocoamine, hydrogenated tallow amine and the like. Examples of secondary amines include dioctadecyl amine, methylbehenyl amine and the like. Amine mixtures are also suitable and many amines derived from natural materials are mixtures. The preferred amine is a secondary hydrogenated tallow amine of the formula $HNR_1R_2$ wherein $R_1$ and $R_2$ are alkyl groups derived from hydrogenated tallow fat composed of approximately 4% $C_{14}$, 31% $C_{16}$, 59% $C_{18}$.

Examples of suitable carboxylic acids for preparing these nitrogen compounds (and their anhydrides) include cyclohexane dicarboxylic acid, cyclohexene dicarboxylic acid, cyclopentane dicarboxylic acid, dialpha-naphthyl acetic acid, naphthalene dicarboxylic acid and the like. Generally these acids will have about 5–13 carbon atoms in the cyclic moiety. Preferred acids useful in the present invention are benzene dicarboxylic acids such as phthalic acid, tere-phthalic acid, and ortho-phthalic acid. Ortho-phthalic acid or its anhydride is the particularly preferred embodiment.

It is preferred that the nitrogen containing compound have at least one straight chain alkyl segment extending from the compound containing 8–40, preferably 14–24 carbon atoms. Also at least one ammonium salt, amine salt or amide linkage is required to be present in the molecule. The particularly preferred amine compound is that amide-amine salt formed by reacting 1 molar portion of phthalic anhydride with 2 molar portions of di-hydrogenated tallow amine. Another preferred emobidment is the diamide formed by dehydrating this amide-amine salt.

Combinations found especially effective in broad boiling distillate fuels are those containing about 10 to 90 wt.%, preferably 50 to 80 wt.% more preferably 60 to 80 wt % of the aforesaid nitrogen compound and about 90 to 10 wt.% preferably 50 to 20 wt.% more preferably 20 to 40 wt % of the polyoxyalkylene ester, ether, ether/ester or mixtures thereof used as the additives of this invention and such a combination and fuels containing such a combination are further embodiments of the present invention.

According to a further embodiment of the present invention the fuel oil composition may also contain a lube oil pour depressant. This has been found particularly useful in improving the flow properties of distillate fuels having higher final boiling points especially those with final boiling points above 385° C. Examples of the preferred lube oil pour depressants are alkyl aromatics such as those made by the Friedel Crafts condensation of a halogenated wax, preferably a straight chain wax with an aromatic hydrocarbon such as naphthalene. Typically suitable halogenated waxes are those containing from 15 to 60, e.g., 16 to 50 carbon atoms and from 5 to 25 wt % preferably 10 to 18 wt % halogen, preferably chlorine.

Alternatively the lube oil pour depressant may be the well known oil soluble esters and/or higher olefin polymers and if so it will generally have a number average molecular weight in the range of about 1000 to 200,000, e.g., 1,000 to 100,000, preferably 1000 to 50,000, as measured, for example, by Vapor Pressure Osmometry such as by a Mechrolab Vapor Pressure Osmometer, or by Gel Permeation Chromatography. These second polymers including copolymers with other unsaturated monomers, e.g. olefins, other than ethylene. Typical polymers are described in published U.K. patent application No. 2,023,645 A.

The relative proportions of the polyoxyalkylene ester, ether, or ester/ether the lube oil pour depressant and any other additives that should be used will depend upon inter alia the nature of the fuel. We prefer, however, to use from 0 to 50 wt.% preferably from 5 wt % to 30 wt % of the lube oil pour depressant based on the total amount of additive present in the distillate fuel the fuel may also contain from 0 to 90 wt.% of other additives of the types herein described.

The additive systems of the present invention may conveniently be supplied as concentrates of the ester, ether, ester/ether or mixtures thereof of the polyoxyalkylene glycol in oil for incorporation into the bulk distillate fuel. These concentrates may also contain other additives as required. These concentrates preferably contain from 3 to 75 wt %, more preferably 3 to 60 wt%,. most preferably 10 to 50 wt % of the additives preferably in solution in oil. Such concentrates are also within the scope of the present invention.

In summary the present invention includes distillate fuel oil boiling in the range about 120° C. to 500° C. including narrow boiling distillates boiling in the range 200° C.±50° C. to 340° C.±20° C. improved in low temperature flow properties by 0.0001 to 0.5 wt.% e.g. 0.001 to 0.5 wt.% of a flow improver comprising 10 to 100 wt.% of a polyoxyalkylene material which is an ester, ether, ether/ester or mixtures thereof containing at least two $C_{10}$ to $C_{30}$ linear saturated alkyl groups and a polyoxyalkylene glycol of molecular weight 100 to 5000 e.g. 200 to 5,000, the alkyl group in said polyoxyalkylene containing 1 to 4 carbon atoms 0 to 90 wt.% e.g. 50 to 90 wt.% of an ethylene other unsaturated monomer e.g. vinyl acetate copolymer 0 to 90 wt.% e.g. 50 to 90 wt.% of a $C_{30}$–$C_{300}$ oil soluble polar nitrogen compound being an amine and/or amide salt and/or ester/amide of a carboxylic acid having 1 to 4 carboxylic acid groups or an anhydride thereof 0 to 50 wt.% e.g. 5 to 30 wt.% of a lube oil pour depressant The flow improver may be solely the polyoxyalkylene material or any combination of the polyoxyalkylene material with one or more of the other components described above. Other additives may be present also.

The invention is further illustrated by the following examples which are not to be considered as limitative of its scope.

In the Examples the fuels that were used in the tests had the properties, set out in Table 1.

TABLE 1

| Fuel | A | B | C | D | E | F | G | H | I |
|---|---|---|---|---|---|---|---|---|---|
| Cloud Point (°C.) | −9 | −9 | −4 | −2 | 1 | −4 | 0 | — | — |
| Wax Appearance Point, WAP (°C.) | −10 | −10 | −7 | −5 | −2.5 | −5.5 | −4 | −0.5 | 1.5 |
| CFPP (°C.) - Untreated | −12 | −12 | −6 | −5 | −3 | −5 | −4 | — | — |
| Wt % Aromatics (FIA)* | 18 | 31 | 40 | 28 | 30 | 31 | 23 | 38 | 29 |
| Wax Content (Wt %), 5° C. below WAP | 2.2 | 1.5 | 2.2 | 4.0 | 0.9 | 1.0 | 1.6 | 0.9 | 0.9 |
| ASTM D86 Distillation | | | | | | | | | |
| Initial Boiling Point, °C. | 220 | 180 | 221 | 202 | 182 | 180 | 156 | 161 | 167 |
| Final Boiling | 341 | 332 | 348 | 343 | 385 | 368 | 355 | 381 | 387 |

TABLE 1-continued

| Fuel | A | B | C | D | E | F | G | H | I |
|---|---|---|---|---|---|---|---|---|---|
| Point, °C. | | | | | | | | | |

*Fluorescence Indicator Analysis

The fuels are typical of European heating and diesel fuels. Fuels A, B, C and D are examples of Narrow Boiling Distillates (NBD's), while E, F, H and I are examples of Broader Boiling Distillates (BBD's) and G is on the boderline between Narrow and Broad boiling.

By one method, the response of the oil to the additives was measured by the Cold Filter Plugging Point Test (CFPPT) which is carried out by the procedure described in detail in "Journal of the Institute of Petroleum", Volume 52, Number 510, June 1966, pp. 173–185. This test is designed to correlate with the cold flow of a middle distillate in automatic diesels.

In brief, a 40 ml sample of the oil to be tested is cooled in a bath which is maintained at about −34° C. to give non-linear cooling at about 1° C./min. Periodically (at each one degree Centigrade drop in temperature starting from at least 2° C. above the cloud point) the cooled oil is tested for its ability to flow through a fine screen in a prescribed time period using a test device which is a pipette to whose lower end is attached an inverted funnel which is positioned below the surface of the oil to be tested. Stretched across the mouth of the funnel is a 350 mesh screen having an area defined by a 12 millimeter diameter. The periodic tests are each initiated by applying a vacuum to the upper end of the pipette whereby oil is drawn through the screen up into the pipette to a mark indicating 20 ml of oil. After each successful passage the oil is returned immediately to the CFPP tube. The test is repeated with each one degree drop in temperature until the oil fails to fill the pipette within 60 seconds. This temperature is reported as the CFPP temperature. The difference between the CFPP of an additive free fuel and of the same fuel containing additive is reported as the CFPP depression by the additive. A more effective additive flow improver gives a greater CFPP depression at the same concentration of additive.

Another determination of flow improver effectiveness is made under conditions of the flow improver distillate operability test (DOT test) which is a slow cooling test designed to correlate with the pumping of a stored heating oil. The cold flow properties of the described fuels containing the additives were determind by the DOT test as follows. 300 ml of fuel are cooled linearly at 1° C./hour to the test temperature and the temperature then held constant. After 2 hours at the test temperature, approximately 20 ml of the surface layer is removed by suction to prevent the test being influenced by the abnormally large wax crystals which tend to form on the oil/air interface during cooling. Wax which has settled in the bottle is dispersed by gentle stirring, then a CFPPT filter assembly is inserted. The tap is opened to apply a vacuum of 500 mm of mercury, and closed when 200 ml of fuel have passed through the filter into the graduated receiver, A PASS is recorded if the 200 ml are collected within ten seconds through a given mesh size or a FAIL if the flow rate is too slow indicating that the filter has become blocked.

CFPPT filter assemblies with filter screens of 20, 30, 40, 60, 80, 100, 120, 150, 200, 250 and 350 mesh number are used to determine the finest mesh (largest mesh number) the fuel will pass. The larger the mesh number that a wax containing fuel will pass, the smaller are the wax crystals and the greater the effectiveness of the additive flow improver. It should be noted that no two fuels will give exactly the same test results at the same treatment level for the same flow improver additive, and, therefore, actual treat levels will vary somewhat from fuel to fuel.

In the Examples the distillate flow improver A1 used was a concentrate in an aromatic diluent of about 50 wt % of a mixture of two ethylene-vinyl acetate copolymers, having different oil solubilities, so that one functioned primarily as a wax growth arrestor and the other as a nucleator, in accord with the teachings of U.K. Pat. No. 1,374,051 and its corresponding U.S. Pat. No. 3,961,916. More specifically, the two polymers are in a ratio of about 75 wt % of wax growth arrestor and about 25 wt % of nucleator. The wax growth arrestor consists of ethylene and about 38 wt % vinyl acetate, and has a number average molecular weight of about 1800 (VPO). It is identified in said U.K. Pat. No. 1,374,051 as Copolymer B of Example 1 (column 8, lines 25–35) and the corresponding U.S. Pat. No. 3,961,916, column 8, line 32. The nucleator consists of ethylene and about 16 wt % vinyl acetate and has a number average molecular weight of about 3000 (VPO). It is identified in said U.K. Pat. No. 1,374,051 as copolymer H (see Table 1, columns 7–8) and the corresponding U.S. Pat. No. 3,961,916, column 8, line 45 Distillate flow improver A2 was the wax growth arrestor component of A1 used on its own.

Polyethylene glycol (PEG) esters and polypropylene glycol (PPG) esters were prepared by mixing one molar proportion of the glycol with one or two molar proportions of the carboxylic acids for the "mono-" and "di-" esters respectively. Para-toluene sulphonic acid was added at 0.5 wt % of the reactant mass as catalyst. The mixture was heated to 150° C. with stirring and a slow stream of nitrogen to distil off water of reaction. When the reaction was completed, as judged by the infrared spectrum, the product was poured out while molten and allowed to cool, giving a waxy solid. Elemental analysis, gel permeation chromatography, saponification, and spectroscopic techniques identified the products.

PEG's and PPG's are usually referred to in combination with their molecular weights, e.g. PEG 600 is a 600 average molecular weight polyethylene glycol. This nomenclature has been continued here to the esters so PEG 600 dibehenate is the ester product of the reaction of two molar proportions of behenic acid with one mole of PEG 600. Mixtures of PEG's of different molecular weights may also be used, e.g. mixed PEG (200/400/600) distearate is the distearate ester of a 1:1:1 by weight mixture of PEG's 200, 400 and 600. Mixtures of carboxylic acids may also be used, e.g. PEG di(-stearate/behenate) is the product from one mole PEG with one mole each of stearic and behenic acids. In both types of mixtures, 2, 3 or several different PEG's, PPG's, PE/PP-G copolymers, and carboxylic acids may be used.

As examples of polar, monomeric, nitrogen containing growth inhibitors, the following compounds designated hereinbelow as "B1", "B2", "B3" and "B4" were used:

B1: The reaction product of one mole of phthalic anhydride with two moles of dihydrogenated tallow amine, to form a half amine/half amide salt.

B2: The phthalic diamide prepared by removing one mole of water per mole of B1.

B3: The di-hydrogenated tallow amine salt of mono-octadecyl phthalate.

B4: The diamide product of reaction and dehydration of two moles of di-hydrogenated tallow amine with one mole of maleic anhydride.

Although many of the additives are available as oil solutions active ingredient (a.i.) as used in the Examples refers to actual amount of additive.

EXAMPLE 1

The performance in the CFPP test of normally difficult to treat narrow boiling distillate fuels containing polyoxyalkylene esters of the present invention was compared with those of the same fuels containing ethylene vinyl acetate (EVA) copolymeric additives, with the following results:

| Flow Improver | ppm of active ingredient | CFPP Depression* Fuel of Table 1 | | | |
|---|---|---|---|---|---|
| | | A | B | C | D |
| A1 | 100 | −1 | 0 | — | 0 |
| A1 | 500 | −1 | −1 | — | 0 |
| A2 | 100 | −1 | 0 | 0 | −1 |
| A2 | 500 | −1 | 2 | 1 | 0 |
| PEG 600 Di-behenate | 100 | 3 | 3 | 4 | 4 |
| Mixed PEG (200/400/600) Di(Stearate/ Behenate) | 100 | 4 | 4 | 5 | 2 |
| Tween 65 | 500 | 1 | 1 | — | 0 |

*A negative value indicates an elevation of the CFPP.
Tween 65 is a polyethoxylated sorbitan tristearate (non-linear)

These results show that in these fuels, significant CFPP depression may be produced by only 100 ppm of PEG ester while 500 ppm of EVA is ineffective.

EXAMPLE 2

The performance of the fuels used in Example 1 containing certain polyglycol esters of the present invention was compared in the DOT test at 5° C. to 7° C. below the fuel WAP (as given in Table 1) with certain commercially available flow improvers with the following results.

| Parts per Million of flow Improver in Fuel | Fuel A 100 | A 500 | B 100 | B 500 | C 100 | C 500 | D 500 |
|---|---|---|---|---|---|---|---|
| Flow Improver | | | | | | | |
| None | 30 | | Block 20 | | Block 20 | | Block 20 |
| A2 | 30 | 60 | 20 | 40 | — | 40 | 40 |
| "Keroflux" H | 30 | 60 | B20 | 40 | — | — | — |
| A1 | 20 | 60 | 40 | 20 | — | — | 60 |
| "Keroflux" M | B20 | 30 | B20 | 40 | — | — | — |
| "Tween 65" | 60 | 120 | 40 | 30 | 100 | — | — |
| Polyethylene Glycol (600) Dibehenate | 80 | 120 | 40 | 80 | — | 120 | 100 |
| Mixed PEG (200/400/600) di(stearate/ behenate) | 150 | 200 | 60 | 200 | 100 | 150 | 100 |

-continued

"Keroflux" H is an ethylene-vinyl acetate copolymer.
"Keroflux" M is an ethylene-2-ethylhexyl acrylate copolymer.
"Tween 65" is a polyethoxylated sorbitan tristearate (non-linear).

These results show the advantage of the PEG esters as flow improvers when compared with various conventional copolymer flow improvers in these fuels. The advantage of the PEG esters over the non-linear ethoxylated ester, "Tween 65", is also illustrated. "Block 20" or "B20" mean the fuel would not pass through a 20 mesh screen.

EXAMPLE 3

The DOT test was used to determine the performance of Fuel A of Table 1 at −15° C., containing 100 parts per million of various polyoxyethylene dibehenates additives in which the polyoxyethylene segments were of different number average molecular weight.

The results were as follows:

| Polyethylene Glycol Mol. Wt. | Finest Mesh Passed Mesh No. |
|---|---|
| No Additive | 20 |
| 100 | 40 |
| 144 | 40 |
| 200 | 150 |
| 400 | 100 |
| 600 | 80 |
| 1,000 | 30 |
| 1,500 | 40 |
| 4,000 | 40 |

This shows the advantage of those esters of PEG's with molecular weights 200 to 600 which are preferred.

EXAMPLE 4

Example 3 was repeated but using as the polyglycol ester 100 ppm of the diester of a 600 molecular weight polyethylene glycol which had been esterified with 2 moles of carboxylic acids of different chain lengths.

The results were as follows:

| Polyethylene Glycol Ester (Carbon Number) | Finest Mesh Passed Mesh No. |
|---|---|
| Laurate ($C_{12}$) | 20 |
| Myristate ($C_{14}$) | 30 |
| Palmitate ($C_{16}$) | 40 |
| Stearate ($C_{18}$) | 40 |
| Behenate ($C_{22}$) | 80 |
| Stearate/Behenate | 100 |
| Mixed PEG 200/400/600 Stearate/Behenate | 150 |

The mixed Stearate/Behenate is obtained by reacting the polyethylene glycol with 2 moles of an equi-molar mixture of stearic and behenic acids.

This example shows the advantage of PEG esters of the higher molecular weight carboxylic acids, and also that esters of single or mixed PEG's with mixtures of carboxylic acids can be advantageous.

EXAMPLE 5

The DOT test was used to compare the flow improving effectiveness of the PEG esters with the PPG esters, and also with mixtures of PPG and PEG esters, in Fuel A of Table 1 (at −15° C.).

| Ester (Molecular Wt) | ppm of Ester (active ingredient) | Finest Mesh Passed Mesh No. |
|---|---|---|
| (a) Mixed PEG (200/400/600) | 100 | 150 |
| di-(stearate/behenate) | 500 | 200 |
| (b) PPG (400) | 100 | 20 |
| di-(stearate/behenate) | 500 | 200 |
| (c) PPG (1,025) | 100 | 30 |
| di-(stearate/behenate) | 500 | 150 |
| (d) PPG (2,025) | 100 | 20 |
| di-(stearate/behenate) | 500 | 60 |

| Ester Mixture (Weight Ratio) | ppm of a.i. | Finest Mesh No. Passed |
|---|---|---|
| (a)/(b) = ¼ | 500 | 250 |
| (a)/(c) = ¼ | 500 | 150 |
| (a)/(d) = ¼ | 500 | 150 |

These results show that the PPG distearate/behenates are also very effective flow improvers at higher concentrations but not as effective as the PEG esters at lower concentrations. The effectiveness of the PPG esters also show a dependence on the PPG molecular weight. Mixtures of PPG and PEG esters can also be used effectively.

EXAMPLE 6

The CFPP depression of Fuel D of Table 1 containing PEG esters of various PEG molecular weights and esterified with different carboxylic acids was measured to be as follows:

| PEG Ester | ppm of Active Ingredient in Fuel D | CFPP Depression |
|---|---|---|
| PEG 600 dilaurate | 100 | 0 |
| PEG 600 dimyristate | 100 | 0 |
| PEG 600 dipalmitate | 100 | 0 |
| PEG 600 distearate | 100 | 0 |
| PEG 600 dibehenate | 100 | 5 |
| PEG 200 dibehenate | 100 | 0 |
| PEG 400 dibehenate | 100 | 4 |
| PEG 600 dibehenate | 100 | 5 |
| PEG 1,000 dibehenate | 100 | 0 |
| PEG 1,500 dibehenate | 100 | 0 |
| Mixed PEG (200/400/600) dibehenate | 100 | 5 |
| Mixed PEG (600/1000) dibehenate | 100 | 5 |

These results show PEG 400 and PEG 600 dibehenates to have both optimum PEG molecular weights and optimum carboxylic acid for CFPP depression in this fuel. For the sake of comparison, the CFPP depression for Fuel D containing 100 ppm of Additive A1 was −1.

EXAMPLE 7

The effectiveness of blends of PEG esters with other additives in NBD's has been determined by the DOT test, in Fuel B of Table 1 at −15° C. "4/1" is a weight ratio.

| Additive | ppm of Active Ingredient | Finest Mesh Number Passed |
|---|---|---|
| PEG 400 Dibehenate | 100 | 40 |
| B1 | 500 | 60 |
| B1/PEG 400 Dibehenate (4/1) | 500 | 200 |
| B1/Tween 65 (4/1) | 500 | 40 |
| A2 | 500 | 40 |
| A2/Mixed PEG di (stearate/behenate) (4/1) | 500 | 60 |

These results show the advantage of the combination of PEG ester with the polar monomer B1, over either alone and over the B1/Tween 65 combination. The performance of the EVA copolymer A2, is also improved by the presence of PEG ester.

EXAMPLE 8

The effectiveness of PEG esters in combination with ethylene/vinyl acetate copolymer growth inhibitor as CFPP depressors in broad boiling Fuel E of Table 1 was found to be as follows:

| EVA (A2) ppm of Polymer | PEG Ester Nature | PEG Ester ppm of Active Ingredient | CFPP Depression (°C.) |
|---|---|---|---|
| 100 | — | 0 | 0 |
| 200 | — | 0 | 2 |
| 80 | PEG dibehenate | 20 | 12 |
| 100 | " | 40 | 15 |
| 0 | " | 100 | 0 |
| 0 | " | 200 | 2 |
| 80 | Mix PEG (600/1000) dibehenate | 20 | 13 |
| 160 | Mix PEG (600/1000) dibehenate | 40 | 18 |
| 0 | Mix PEG (600/1000) dibehenate | 200 | 2 |
| 150 | $C_{28}$-$C_{30}$ mixed PEG ester* | 50 | 16 |

*Made by the esterification of 1 mole of the mixed PEG (200/400/600) with 2 moles of the saturated carboxylic acid derived from the reaction of $C_{26}$-$C_{28}$ alpha olefins with acetic anhydride, in the presence of di-t-butyl-peroxide as catalyst.

These results show how very effective such combinations are, over the components separately.

EXAMPLE 9

The effectiveness of PEG esters in combination with polar monomeric compounds as CFPP depressors in Fuel F of Table 1 are found to be as follows:

| Additive | ppm of a.i. | PEG Ester | ppm of a.i. | CFPP Depression |
|---|---|---|---|---|
| A2 (for comparison) | 75 | — | 0 | 0 |
| A2 | 75 | PEG 600 dibehenate | 25 | 10 |
| A2 | 75 | PEG 600 distearate | 25 | 0 |
| B1 | 75 | — | 0 | 0 |
| B1 | 75 | PEG 600 dibehenate | 25 | 6 |
| B2 | 75 | — | 0 | 4 |
| B2 | 75 | PEG 600 dibehenate | 25 | 7 |
| B3 | 75 | — | 0 | 2 |
| B3 | 75 | PEG 600 dibehenate | 25 | 12 |

These results show the advantage of the PEG dibehenate over the distearate, when used in combination with A2, and the benefit of using for a component such as PEG 600 dibehenate, in this application. Also that polar monomeric compounds can be effective CFPP depressors when used in combination with the PEG 600 ester.

EXAMPLE 10

In this example the effectiveness of PEG ester/A2 combinations are tested by the DOT test at −12° C.

| Growth Inhibitor ppm (a.i.) | | PEG Ester | ppm of a.i. | Finest Mesh Number Passed |
|---|---|---|---|---|
| Fuel E of Table 1 | | | | |
| A2 | 200 | — | 0 | 150 |
| A2 | 170 | PEG 600 dibehenate | 30 | 250 |
| A2 | 170 | Mixed PEG (400/600/1,000) di (stearate/behenate) | 30 | 250 |
| Fuel G of Table 1 | | | | |
| A2 | 500 | — | 0 | 40 |
| A2 | 400 | Mixed PEG (200/400/600) di (stearate/behenate) | 100 | 150 |
| B1 | 400 | Mixed PEG (200/400/600) di (stearate/behenate) | 100 | 200 |

These results show the greater effectiveness of combinations of PEG esters with EVA copolymer or polar monomeric wax crystal growth inhibitors over an equivalent concentration of the growth inhibitor alone.

EXAMPLE 11

In this example, the results are from three 25 $m^3$ tanks of Fuel D of Table 1 which were tested side by side. Over a period of three weeks storage, under natural cold conditions (including natural temperature cycling), the fuel at −13.5° C. was pumped out of the tanks as in a fuel distribution situation and the finest filter screen through which fuel would flow was recorded.

| Additive (at 0.1% of Active Ingredient) | Finest Mesh Passed |
|---|---|
| (a) A1 | 40 |
| (b) Mixed PEG (200/400/600) di (stearate/behenate) | 60 |
| (c) A2/mixed PEG ester as (b) (3/1 ratio) | 80 |

The filter screens usually used in such fuel distribution equipment are of 60 mesh number and so it can be seen that while the fuel containing EVA copolymer A1 gave unsatisfactory performance by blocking a 60 mesh number filter, the fuel containing PEG ester alone and fuel containing an EVA copolymer/PEG ester combination gave satisfactory flow on pumping.

EXAMPLE 12

Three barrels of Fuel A of Table 1 were cooled at 0.5° C./hour to −13° C. and after a cold soak period, a 300 ml sample of the fuel was tested for its cold flow performance, as in the DOT. The barrels were then slowly heated to above the WAP of the fuel, then cooled again at 0.5° C./hour to −13° C. The fuel was then pumped out of the barrels through a range of filter screens to determine the finest that the waxy fuel could pass through.

| Additive | ppm a.i. | Finest Mesh Passed (Mesh No.) First Cool | Second Cool |
|---|---|---|---|
| A1 | 500 | 60 | 40 |
| Mixed PEG (200/400/600) | 100 | 80 | 80 |
| di(Stearate/Behenate | 500 | 120 | 120 |
| Mixed PEG ester (as above)/PPG (1025) dibehenate | 100/400 | 120 | 100 |

The advantage of PEG esters and a PEG ester/PPG ester blend over the ethylene/vinyl acetate copolymer A1 is reconfirmed.

EXAMPLE 13

The DOT test was used at a test temperature of −10° C. to compare the linear saturated esters with linear unsaturated esters, e.g., an oleic acid ester.

| Fuel of Table 1 | Additive | ppm | Finest Mesh Passed |
|---|---|---|---|
| D | PEG (600) Dibehenate | 500 | 100 |
| D | PEG (600) Dioleate | 500 | Block 20 |
| D | None | 0 | Block 20 |

EXAMPLE 14

The DOT test was repeated in a series of three broad boiling distillate fuels and illustrates the effectiveness of linear PEG esters even when used alone in such fuels.

Comparative data is provided with the "A2" ethylene-vinyl acetate copolymer as well as with a dioleate ester to show the criticality associated with a linear saturated alkyl ester.

| Fuel of Table 1 | Additive | ppm | Finest Mesh Passed |
|---|---|---|---|
| E | A2 | 200 | 200 |
| E | PEG (600) Dibehenate | 200 | 200 |
| E | PEG (600) Dioleate | 200 | 40 |
| E | None | — | 30 |
| H | A2 | 300 | 100 |
| H | PEG (600) Dibehenate | 300 | 100 |
| H | PEG (600) Dioleate | 300 | 40 |
| H | None | — | 40 |
| I | A2 | 250 | 120 |
| I | PEG (600) Dibehenate | 250 | 200 |
| I | PEG (600) Dioleate | 250 | 80 |
| I | None | — | 80 |

EXAMPLE 15

A fuel of relative high boiling point having the following characteristics:

| | |
|---|---|
| Cloud Point (°C.) | +4 |
| Wax Appearance Point (°C.) | −0.7 |
| CFPP (°C.) - Untreated | −5 |

-continued

| ASTM D86 Distillation | |
|---|---|
| Initial Boiling Point, °C. | 185 |
| Final Boiling Point, °C. | 386 |

was treated with varying amounts of an additive mixture comprising a blend of 1 part by weight of PEG (600) dibehenate and 4 parts by weight of additive A2 with the following results:

| Additive Treat Rate (ppm) | CFPP, °C. |
|---|---|
| 150 | −14 |
| 200 | −14 |
| 250 | −14 |
| 300 | −14 |
| 350 | −16 |
| 450 | −16 |
| 500 | −16 |
| 550 | −7 |
| 650 | −7 |

In this Example, the CFPP values are the actual temperature at which the fuel failed the CFPP test. 10 wt % based on the total weight of additive of a wax naphthalene made by Friedel Crafts condensation of about 100 parts by weight of n-paraffin wax having a melting point of about 125°-129° F. chlorinated to about 14.5 wt % chlorine based on weight of chlorinated wax and about 12 parts by weight of naphthalene (known as C) was added, and the CFPP performance of the fuels containing the mixture used above were as follows:

| Treat Rate | CFPP, °C. |
|---|---|
| 550 ppm of Blend + 55 ppm of C | −19 |
| 650 ppm of Blend + 65 ppm of C | −20 |

For example this data shows the further improvement achieved in this fuel by the incorporation of C.

EXAMPLE 16

The DOT test was used with Fuel A at a temperature of −15° C. to compare PEG 600 Distearate and PEG 600 Diisostearate at a treat rate of 200 parts per million of the additive. The results were as follows:

| Additive | P.P.M. a.i. | Finesh Mesh Passed |
|---|---|---|
| PEG 600 Distearate | 200 | 40 Mesh |
| PEG 600 Di-isostearate | 200 | Blocked 20 |

thus showing the benefit of the linear alkyl group.

EXAMPLE 17

Polytetramethylene glycols, "Teracols", of general formula $HO—[(CH_2)_4—O]_n—H$ were prepared of molecular weights 650, 1000 and 2000 and esterified with two moles of behenic acid. These materials were then tested in Fuel A in the DOT test at a temperature of −15° C. with the following results.

| Additive | P.P.M. (a.i.) | Finest Mesh Passed |
|---|---|---|
| Teracol (650) dibehenate | 200 | Block 20 |
| Teracol (1000) dibehenate | 200 | 30 |
| Teracol (2000) dibehenate | 200 | 40 |

Thus showing cerain the Teracol derivatives to be active but as comparison with Example 3 shows less active than the comparable PEG and PPG esters.

EXAMPLE 18

A $C_{18}$ linear alcohol was ethoxylated and the resulting product esterified with one mole of behenic acid to give an ester ether of the following structure $$C_{18}—O—(CH_2CH_2O)_{10}—\overset{\overset{\displaystyle O}{\|}}{C}—C_{21}$$

This additive gave a 80 mesh pass in Fuel A in the DOT test at −15° C. and at a concentration of 200 p.p.m.

EXAMPLE 19

PEG 600 was reacted with 2 moles of succinic acid and this product then reacted with 2 moles of a $C_{22}/C_{24}$ mixed, straight chain, saturated alcohol to give the product $$(C_{22}/C_{24})—O—\overset{\overset{\displaystyle O}{\|}}{C}—CH_2—CH_2—\overset{\overset{\displaystyle O}{\|}}{C}—O(\text{PEG 600})\text{-}O—\overset{\overset{\displaystyle O}{\|}}{C}—CH_2—CH_2—\overset{\overset{\displaystyle O}{\|}}{C}—O(C_{22}/C_{24})$$

This was tested in Fuel J which had a cloud point of +4° C., a wax appearance point of 0° C., a CFPP performance of −1° C., an Initial Boiling Point of 195° C. and a Final Boiling Point of 375° C. The product was tested in the DOT test at −6° C. and the fuel with no additive passed a 40 mesh screen whilst that containing 200 p.p.m. of additive passed an 80 mesh screen Incorporating 200 p.p.m. of this additive in fuel A gave a 100 mesh pass at −15° C. in the DOT test.

EXAMPLE 20

The effect of PEG (600) Dibehenate was compared with that of PEG (600) Dierucate in Fuel K which had a cloud point of −2° C.; a wax appearance point of −6° C. an Initial Boiling Point of 200° C. and a Final Boiling Point of 354° C. The untreated fuel had a CFPP of −7° C. which was unaltered by the addition of PEG (600)dierucate but reduced by 4° C. by the PEG(600) Dibehenate showing the importance of the alkyl group being saturated.

EXAMPLE 21

Mixtures of 4 parts of Distillate flow improver A2 and of 1 part of different PEG debehenates were tested in the CFPP test in Fuel E with the following results.

| Additive | CFPP 100 P.P.M. Additive | Depression 200 P.P.M. Additive |
|---|---|---|
| $A_2$ Alone | 1 | 2 |
| EVA PEG ester | | |

-continued

| Additive | CFPP 100 P.P.M. Additive | Depression 200 P.P.M. Additive |
|---|---|---|
| 4: 1 | | |
| $A_2$ PEG (200) Dibehenate | 1 | 2 |
| $A_2$ PEG (400) Dibehenate | 1 | 2 |
| $A_2$ PEG (600) Dibehenate | 13 | 16 |
| $A_2$ PEG (1000) Dibehenate | 14 | 17 |
| $A_2$ PEG (1500) Dibehenate | 14 | 17 |
| $A_2$ PEG (4000) Dibehenate | 3 | 3 |
| $A_2$ PEG (600/1000/1500) Dibehenate | 14 | 18 |
| PEG (600) Dibehenate Alone | 6 | |
| *P (EO/PO) 8000 Dibehenate | 0 | 0 |

*A Poly (Ethylene Oxide/Propylene Oxide) of 8000 molecular weight condensed with two moles of behenic acid.

EXAMPLE 22

Example 21 was repeated using Teracol derivatives in place of the PEG dibehenates with the following results

| Additive | CFPP Depression 100 P.P.M Additive |
|---|---|
| Teracol 650 Dibehenate 4:1 | 3 |
| *$A_2$ Teracol (650) Dibehenate | 0 |
| Teracol (1000) Dibehenate | 0 |
| *$A_2$ Teracol (1000) Dibehenate | 3 |
| Teracol 2000 Dibehenate | 3 |
| *$A_2$ Teracol (2000) Dibehenate | 0 |

*A ratio of EVA/Teracoldibehenate of 4:1.

Showing the Teracol derivatives to be much less effective than the PEG derivatives.

EXAMPLE 23

Various additives were tested in the DOT test at −10° C. in Fuel L which had a cloud point of −4° C., a wax appearance point of −6° C., an untreated CFPPT of −6° C., an Initial Boiling Point of 216° C. and a Final Boiling Point of 353° C. The results were as follows

| Additive | P.P.M. (a.i.) | DOT Test Finest Mesh Passed |
|---|---|---|
| None | — | Block 20 |
| PEG (600) Dibehenate | 100 | 150 |
| PEG (600) Monobehenate | 100 | 40 |
| Teracol (650) Dibehenate | 100 | 30 |
| Teracol (1000) Dibehenate | 100 | 20 |
| Teracol (2000) Dibehenate | 100 | 20 |
| Poly(E.O./P.O.-8000 Molecular Weight) Dibehenate | 100 | 20 |
| | 500 | 20 |

EXAMPLE 24

The CFPP depression of Fuel D containing various additives was found to be as follows:

| Additive | P.P.M. (a.i.) | CFPP Depression (°C.) |
|---|---|---|
| PEG 200/400/600 Dibehenate | 250 | 4 |
| $C_{21}H_{43}C(=O)-(OH_2CH_2)_8OH$ | 250 | −1 |
| | 500 | −1 |
| $C_{18}H_{37}-O-(CH_2CH_2O)_{10}-H$ | 250 | −2 |
| | 500 | −5 |
| $C_{18}H_{37}-O-(CH_2CH_2O)_{10}-C(=O)-C_{21}H_{43}$ | 250 | 1 |
| | 500 | 3 |

What is claimed is:

1. A distillate fuel oil containing 0.001 to 0.5 wt% of a flow improver being a polyoxyalkylene ester, ether, ester/ether or mixtures thereof which contain at least two $C_{10}$ to $C_{30}$ linear saturated alkyl groups and a polyoxyalkylene glycol of molecular weight in the range of about 100 to 5000 the alkylene group of said polyoxyalkylene glycol containing from 1 to 4 carbon atoms.

2. A distillate fuel oil according to claim 1 boiling in the range of 200°±50° C. to 340° C.±20° C. wherein said flow improver additive is an ester.

3. A fuel oil according to claim 1 wherein the polyoxyalkylene glycol is of molecular weight in the range of 200 to 2,000.

4. A fuel oil according to claim 2 wherein the $C_{10}$ to $C_{30}$ linear saturated alkyl group is stearic and/or behenic.

5. A fuel oil composition comprising a middle distillate fuel oil having a boiling range from about 120° C. to 500° C. containing about 0.0001 to 0.5 wt % of a flow improver which is a polyoxyalkylene material which is an ester, ether, ester/ester or mixtures thereof of the general formula $$R-O-(A)-O-R^1$$

where R and $R^1$ are the same or different and may be (i) n-Alkyl (ii) $\text{n-Alkyl-C}(=O)-$ (iii) $\text{n-Alkyl-O-C}(=O)-(CH_2)_n-$ (iv) $\text{n-Alkyl-O-C}(=O)-(CH_2)_n-C(=O)-$ the alkyl group being linear and saturated and containing 10 to 30 carbon atoms and A is a polyoxyalkylene glycol of molecular weight in the range of about 100 to 5,000 wherein the alkylene group contains from 1 to 4 carbon atoms.

6. The composition of claim 5 wherein the fuel oil is a narrow boiling distillate fuel having a boiling range of about 200° C.±50° C. to 340° C.±20° C.

7. The composition of claim 5 wherein R and $R^1$ contain 18 to 22 carbon atoms.

8. The composition of claim 5 wherein the polyoxyalkylene glycol is a polyethylene glycol.

9. The composition of claim 8 wherein the polyethylene glycol has a molecular weight in the range of about 200 to 2,000.

10. The composition of claim 5 wherein the glycol is a mixture of polyethylene and polypropylene glycols.

11. The composition of claim 5 wherein the acid is behenic acid and the glycol has a molecular weight of in the range of about 200 to 800.

12. The composition of claim 5 also containing a lube oil pour depressant wherein the lube oil pour depressant is a $C_{15}$–$C_{60}$ alkylated naphthalene, an oil soluble ester or an olefin polymer of average molecular weight 1,000 to 200,000.

13. A distillate fuel containing a combination flow improver additive comprising (i) an ester,ether, ester/ether or mixtures thereof of the general formula $$R—O—(A)—O—R^1$$

Where R and $R^1$ are the same or different and may be (i) n-Alkyl $$\text{n-Alkyl-}\overset{\overset{\displaystyle O}{\|}}{C}— \quad \text{(ii)}$$

$$\text{n-Alkyl-O—}\overset{\overset{\displaystyle O}{\|}}{C}\text{—}(CH_2)_n— \quad \text{(iii)}$$

$$\text{n-Alkyl-O—}\overset{\overset{\displaystyle O}{\|}}{C}\text{—}(CH_2)_n\text{—}\overset{\overset{\displaystyle O}{\|}}{C}— \quad \text{(iv)}$$

the alkyl group being linear and saturated and containing 10 to 30 carbon atoms and A is a linear polyoxyalkylene glycol of molecular weight in the range of about 100 to 5,000 wherein the alkylene group contains 1 to 4 carbon atoms and (ii) an ethylene copolymer wax crystal growth inhibitor or a $C_{30}$–$C_{300}$ oil soluble polar nitrogen compound wax crystal growth inhibitor being an amine and/or amide salt and/or ester/amide of a carboxylic acid having 1 to 4 carboxylic acid groups or an anhydride thereof.

14. The distillate fuel of claim 13 wherein the ethylene copolymer is an ethylene vinyl acetate copolymer.

15. The distillate fuel of claim 13 containing from 10 to 90 wt.% of the polyoxyalkylene glycol and 90 to 10 wt.% of the ethylene copolymer based on the total weight of additive in the fuel.

16. The distillate fuel of claim 13 wherein the polar nitrogen compound is the reaction product of a $C_{12}$–$C_{40}$ secondary amine and phthalic anhydride.

17. The distillate fuel of claim 16 containing from 10 to 90 wt.% of the ester, ether, ester/ether of the polyoxyalkylene glycol or mixtures thereof and from 90 to 10 wt.% of the $C_{30}$ to $C_{300}$ oil soluble polar nitrogen compound.

18. An additive concentrate for incorporation into distillate fuel containing from 3 to 75 wt.% of an ester, ether, ester/ether or mixtures thereof of the general formula $$R—O—(A)—O—R^1$$

where R and $R^1$ are the same or different and may be (i) n-Alkyl $$\text{n-Alkyl-}\overset{\overset{\displaystyle O}{\|}}{C}— \quad \text{(ii)}$$

$$\text{n-Alkyl-O—}\overset{\overset{\displaystyle O}{\|}}{C}\text{—}(CH_2)_n— \quad \text{(iii)}$$

$$\text{n-Alkyl-O—}\overset{\overset{\displaystyle O}{\|}}{C}\text{—}(CH_2)_n\text{—}\overset{\overset{\displaystyle O}{\|}}{C}— \quad \text{(iv)}$$

the alkyl group being linear and saturated and containing 10 to 30 carbon atoms, and A is a polyoxyalkylene glycol of molecular weight in the range of about 100 to 5,000 wherein the alkylene group contains from 1 to 4 carbon atoms.

19. An additive concentrate according to claim 18 containing 3 to 60 wt.% of the ester, ether, ester/ether or mixtures thereof.

20. An additive concentrate according to claim 18 also containing an ethylene copolymer wax crystal growth inhibitor or a $C_{30}$–$C_{300}$ oil soluble polar nitrogen compound wax crystal growth inhibitor being an amine and/or amide salt and/or ester/amide of a carboxylic acid having 1 to 4 carboxylic acid groups or an anhydride thereof.

21. An additive concentrate according to claim 20 containing from 60 to 80 wt.% based on the total additive content of the concentrate of the ethylene copolymer or $C_{30}$–$C_{300}$ oil soluble polar nitrogen compound.

22. A distillate fuel containing a combination flow improver additive comprising (i) 20 to 40 wt.% of an ether, ester/ether or mixtures thereof of the general formula $$R—O—(A)—O—R^1$$

Where R and $R^1$ are the same of different and may be (i) n-Alkyl $$\text{n-Alkyl-}\overset{\overset{\displaystyle O}{\|}}{C}— \quad \text{(ii)}$$

$$\text{n-Alkyl-O—}\overset{\overset{\displaystyle O}{\|}}{C}\text{—}(CH_2)_n— \quad \text{(iii)}$$

$$\text{n-Alkyl-O—}\overset{\overset{\displaystyle O}{\|}}{C}\text{—}(CH_2)_n\text{—}\overset{\overset{\displaystyle O}{\|}}{C}— \quad \text{(iv)}$$

the alkyl group being linear and saturated and containing 10 to 30 carbon atoms and A is a polyoxyalkylene glycol of molecular weight in the range of about 100 to 5,000 wherein the alkylene group contains 1 to 4 carbon atoms and (ii) 80 to 60 wt.% of an ethylene copolymer wax crystal growth inhibitor or a $C_{30}$–$C_{300}$ oil soluble polar nitrogen compound wax crystal inhibitor being an amine and/or amide salt and/or ester/amide of a carboxylic acid having 1 to 4 carboxylic acid groups or an anhydride thereof.

23. The distillate fuel of claim 22 wherein the ethylene copolymer is an ethylene vinyl acetate copolymer.

24. The distillate fuel of claim 22 wherein the polar nitrogen compound is the reaction product of $C_{12}$–$C_{40}$ secondary amine and phthalic anhydride.

25. Distillate fuel oil boiling in the range about 120° C. to 500° C. including narrow boiling distillates boiling in the range 200° C.±50° C. to 340° C.±20° C. improved in low temperature flow properties by 0.0001 to 0.5 wt.% of a flow improver comprising 10 to 100 wt.% of a polyoxyalkylene material which is an ester, ether, ether/ester or mixtures thereof containing at least two $C_{10}$ to $C_{30}$ linear saturated alkyl groups and a polyoxyalkylene glycol of molecular weight 100 to 5000 containing 1 to 4 carbon atoms 0 to 90 wt.% of an ethylene/unsaturated monomer copolymer 0 to 90 wt.% $C_{30}$–$C_{300}$ oil soluble polar nitrogen compound being an amine and/or amide salt and/or ester/amide of a carboxylic acid having 1 to 4 carboxylic acid groups or an anhydride thereof 0 to 50 wt.% of a lube oil pour depressant.

* * * * *